US005460586A

United States Patent [19]

Wilkinson et al.

[11] Patent Number: 5,460,586

[45] Date of Patent: Oct. 24, 1995

[54] UNIVERSAL ADAPTABLE ADJUSTABLE ARM EXERCISE DEVICE TO SUPPLEMENT LEG EXERCISING

[75] Inventors: William T. Wilkinson, Severnside Farm, 300 Kyle Rd., Crownsville, Md. 21032-0572; John J. Nelson, Levitown, Pa.

[73] Assignee: William T. Wilkinson, Crownsville, Md.

[21] Appl. No.: 299,242

[22] Filed: Aug. 31, 1994

Related U.S. Application Data

[63] Continuation of Ser. No. 55,750, May 3, 1993, abandoned, which is a continuation-in-part of Ser. No. 945,373, Sep. 16, 1992, Pat. No. 5,207,622, and Ser. No. 986,487, Dec. 7, 1992, abandoned.

[51] Int. Cl.[6] ..... A63B 22/02; A63B 21/015

[52] U.S. Cl. ..... 482/54; 482/51; 482/118

[58] Field of Search ..... 482/51, 52, 53, 482/54, 70, 71, 148, 27, 118, 62, 72

[56] References Cited

U.S. PATENT DOCUMENTS

| | | | |
|---|---|---|---|
| 3,298,688 | 1/1967 | Grzybowski . | |
| 4,598,905 | 7/1986 | Vrana . | |
| 4,618,139 | 10/1986 | Haaheim . | |
| 4,723,774 | 2/1988 | Monforte . | |
| 4,743,015 | 5/1988 | Marshall . | |
| 4,776,581 | 10/1988 | Shepherdson | 482/27 |
| 4,804,178 | 2/1989 | Friedebach . | |
| 4,826,152 | 5/1989 | Lo . | |
| 4,948,121 | 8/1990 | Haaheim et al. | 482/70 |
| 5,007,638 | 4/1991 | Yuki . | |
| 5,058,881 | 10/1991 | Meason | 482/54 |
| 5,074,550 | 12/1991 | Sloan . | |
| 5,110,117 | 5/1992 | Fisher et al. | 482/54 |
| 5,145,481 | 9/1992 | Friedebach | 482/70 |
| 5,162,029 | 11/1992 | Gerard | 482/54 |
| 5,207,622 | 5/1993 | Wilkinson | 482/54 |
| 5,299,992 | 4/1994 | Wilkinson | 482/62 |

*Primary Examiner*—Stephen R. Crow
*Attorney, Agent, or Firm*—Connolly & Hutz

[57] ABSTRACT

A universally adaptable adjustable arm exercise device to supplement leg exercising includes a leg exercising unit having a foot contact surface. A pole is mounted adjacent each of two opposite sides of the foot contact surface. The mounting is accomplished by each pole being mounted to a mounting bracket secured to the leg exercise unit. A hinge pin extends from each bracket with a respective pole pivotally mounted to one of the hinge pins. An adjustable resistance device is provided on each of the hinge pins with a resistance setting member on each hinge pin for controlling the resistance force required for a user to pivot the poles back and forth and thereby provide an arm exercise simultaneously with the use of the leg exercise unit. The poles could be part of a self contained unit which could slide under various types of leg exercise units.

9 Claims, 10 Drawing Sheets

Fig. 1A.
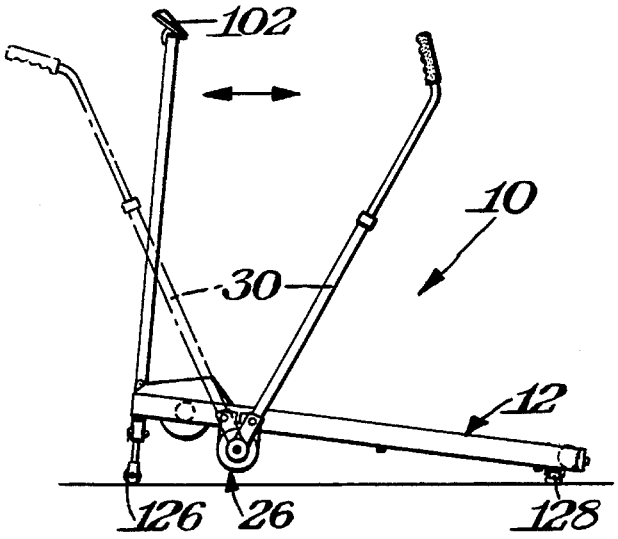
Fig. 1.
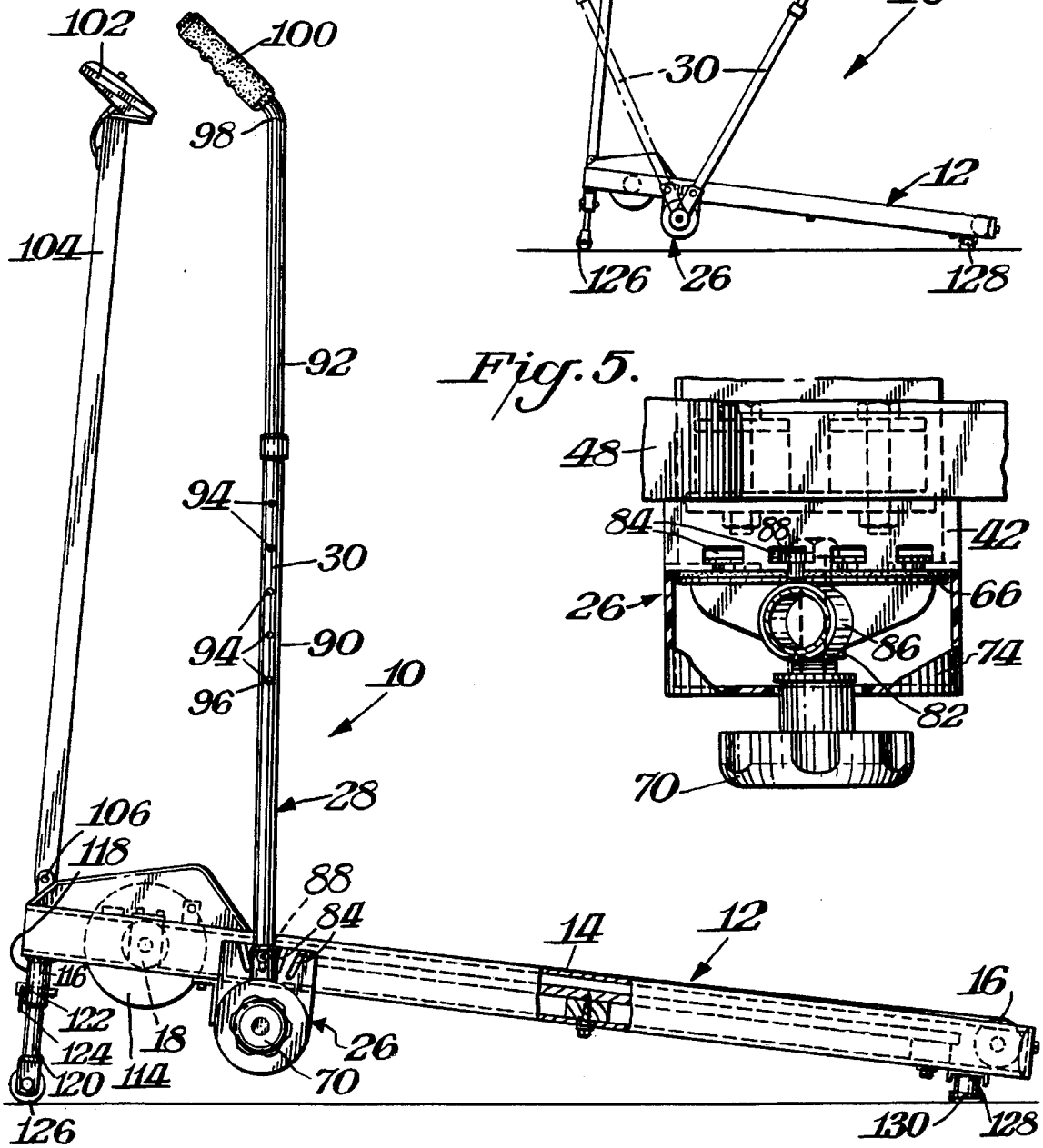
Fig. 5.

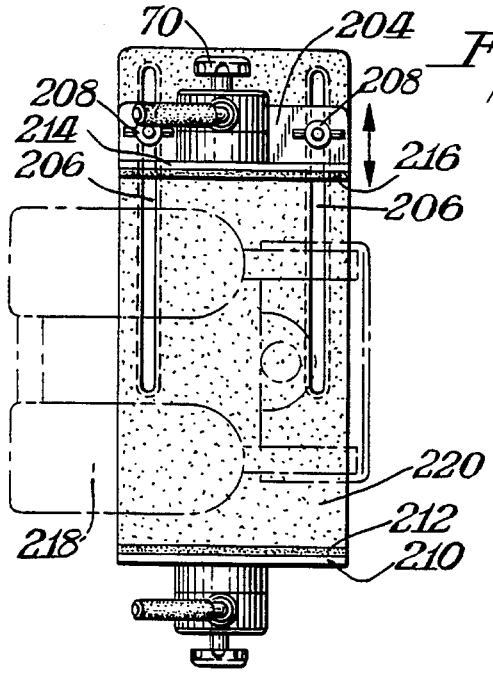
Fig. 11
Fig. 10.
Fig. 9.
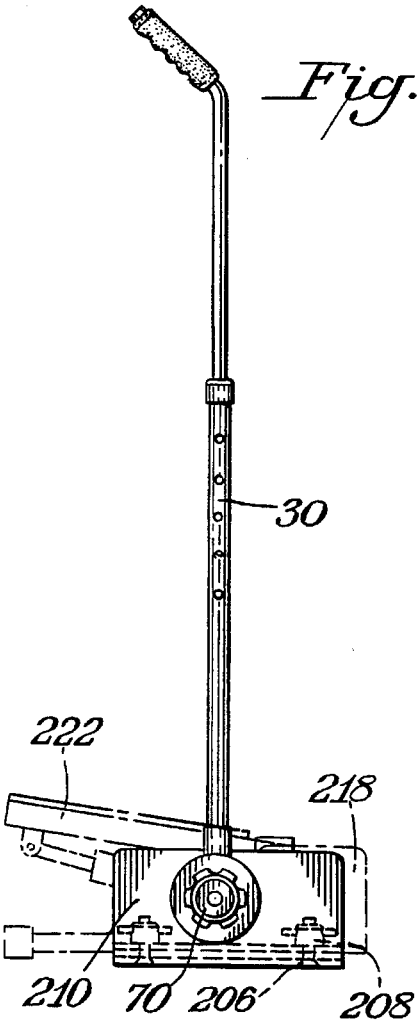
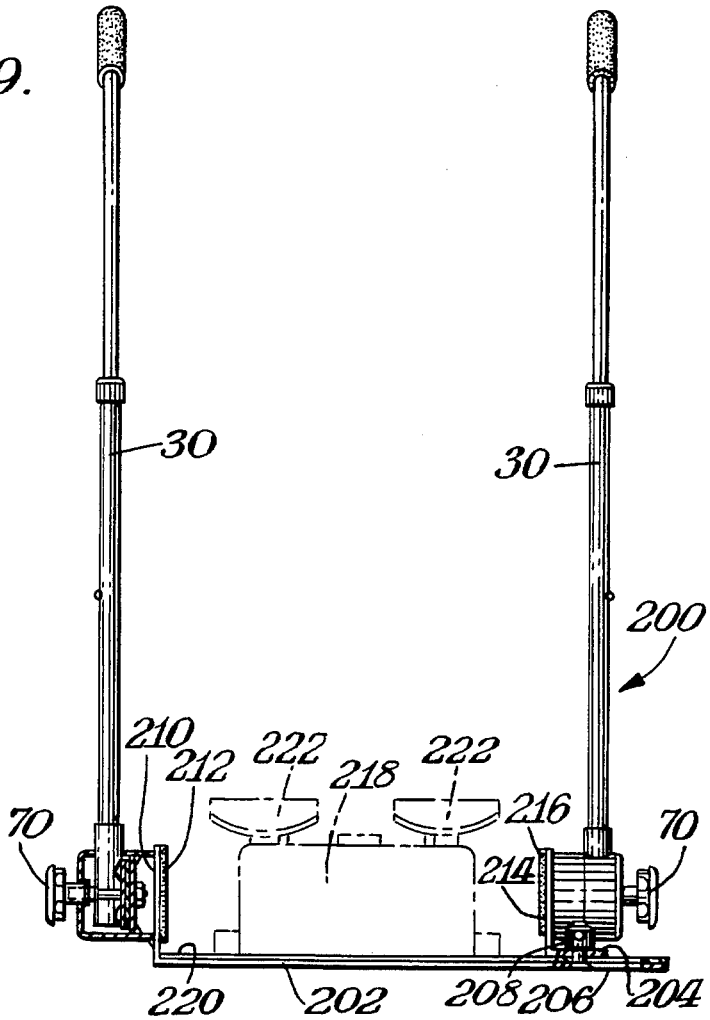

UNIVERSAL ADAPTABLE ADJUSTABLE ARM EXERCISE DEVICE TO SUPPLEMENT LEG EXERCISING

CROSS-REFERENCE TO RELATED APPLICATIONS

This application is a continuation of application Ser. No. 08/055,750 filed on May 3, 1993, now abandoned, which application is a continuation in part of application Ser. No. 945,373, filed Sep. 16, 1992 now U.S. Pat. No. 5,267,622 and of application Ser. No. 986,487, filed Dec. 7, 1992, now abandoned.

BACKGROUND OF THE INVENTION

Currently there is an increasing emphasis on aerobic exercise. Many types of machines have been devised to provide the user with simulated types of exercise. At the same time there has also been a trend for total body exercise. This has led to the provision of various dual action machines to exercise both the arms and the legs. An example is found in U.S. Pat. No. 5,110,117 which provides a treadmill with pivoting handles. Most of the commercial machines, however, exercise just the legs and not the arms. Often the leg exercise units include a balance rail or bar which could be held by the user's hands during the leg exercise.

There is a need for a device which could effectively exercise the arms to provide an upper body dimension for both new and existing aerobic exercise machines. An ideal device would include the features of either being permanently or detachably mounted to the aerobic exercise machine which provides the ability to have a leg exercise. Additionally, such device should be adaptable in many different types and sizes of aerobic exercise devices. Further, such device should be adjustable in the height/length of the poles so as to accommodate different size people. Still further the device should have adjustable tension to vary the level of workout. Such device should also have adjustable pole positions and comfortable hand grips as well as adjustable hand grips.

SUMMARY OF THE INVENTION

An object of this invention is to provide a universally adaptable adjustable arm exercise device which fulfills the above needs by supplementing leg exercises in aerobic workouts.

A further object of this invention is to provide such a device which may be used with various types of leg exercise units such as treadmills, steppers, stationary bicycles, and cross-country ski machines.

A still further object of this invention is to provide such a device which could be easily detachably mounted to a leg exercise unit, such as a treadmill, so that owners of existing leg exercise units need only mount the arm exercise device to the unit to achieve a total body workout.

In accordance with this invention, the universally adaptable adjustable arm exercise device for supplementing leg exercising includes a leg exercise unit having a foot contact surface, such as a treadmill. A pole is mounted on each side of the foot contact surface by means of a mounting bracket having a hinge pin extending from each bracket so that the respective pole may be pivotally secured to a respective hinge pin. Adjustable resistance means is provided on each of the hinge pins with an adjustable resistance setting member on each of the hinge pins for controlling the resistance force of the resistance means and thereby control the force required by a user to pivot the poles back and forth thus providing an arm exercise simultaneously with the leg exercise unit.

In the preferred practice of this invention the resistance means is a resistance plate or brake disk mounted between the pole and the bracket with the resistance setting member being a knob on the hinge pin for tightening or loosening the mounting of the pole against the bracket.

The pole and bracket may include complementary means to selectively mount the poles in a rigid nonpivoting position when it is desired to use the poles for balance purposes during use of the leg exercise unit.

In a preferred practice of the invention each mounting bracket is detachably mounted to the leg exercise unit so that the device can be added to existing leg exercise units. The detachable mounting may be accomplished by providing frames slidably mounted on rods for movement toward and away from each other thereby varying the distance between the mounting brackets.

The device may include a column having an electronic unit mounted at the top of the column for indicating various parameters indicative of the aerobic exercise.

In the preferred practice of the invention the poles are mounted in such a manner that the poles can be moved toward their stored position by being disposed generally in line with the foot contact surface, such as the belt or rollers of a treadmill. Similarly, the electronic unit column may be pivotally mounted for being disposed in line with the foot contact surface so as to provide a collapsed unit of compact size which facilitates the storage and transportation of the device. Transportation of the device may also be facilitated by providing legs on the device with wheels or rollers at the end of each leg thereby permitting the device to be rolled on end to its desired location.

The poles may be in a self contained unit which could slide under any suitable leg exercise unit.

THE DRAWINGS

FIG. 1 is a front elevational view of a universally adaptable adjustable arm exercise device in accordance with this invention shown in the locked condition;

FIG. 1A is a view similar to FIG. 1 showing the device in the pole movement condition;

FIG. 5 is a plan view partly in section of a portion of the device shown in FIGS. 1–4;

FIG. 9 is a side elevational view of an arm exercise unit used in combination with a stepper;

FIG. 10 is a front elevational view of the device shown in FIG. 9;

FIG. 11 is a top plan view of the device shown in FIGS. 9–10;

DETAILED DESCRIPTION

Figure 2:
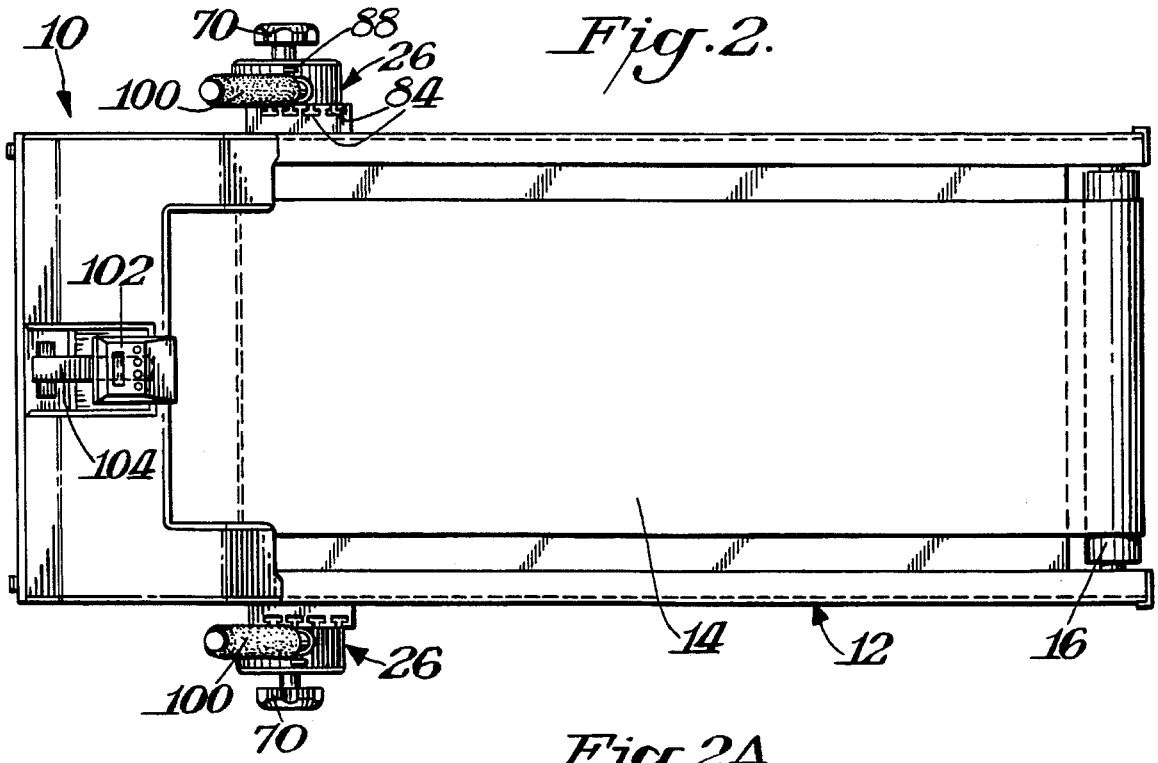
FIG. 2 is a top plan view of the device shown in FIG. 1 in the form of a treadmill having a belt with no rollers.

The present invention is intended to provide a universally adaptable adjustable arm exercise device which supplements aerobic exercises such as leg exercising. In general, the device includes a pair of poles which would be held by the user's hands and which could selectively be pivoted to provide an arm exercise simultaneously with the leg exercise or when desired to simply provide balance while doing the leg exercise. It is to be understood that the invention is intended to complement various forms of aerobic exercise units, particularly leg exercise units. For illustrative purposes the leg exercise units shown and described in connection with FIGS. 1–8 and 12–13 are forms of treadmills. The invention, however, may be practiced with other types of units including an XC (cross-country) ski machine, stationary bikes in either upright or incumbent form, steppers/step climbers, trampolines, rowers, chairs and benches. Although such devices such as XC ski machines and rowers have an upper body exercise mechanism, the present invention provides a different type or form of arm exercise than provided by such exercise unit. It is also to be understood that the arm exercise device could be mounted on various structures where all that is intended is to provide an upper body exercise or running in place.

FIGS. 1–8 illustrate one manner of practicing this invention. As shown therein the exercise device 10 includes a leg exercising unit in the form of a treadmill 12. Treadmill 12 may be of any suitable known construction. For example, as illustrated treadmill 12 includes an endless belt 14 mounted for movement over rollers 16,18 at opposite ends thereof spaced over a support member 20 in frame 22. Front roller 18 is motor driven as is known in the art. FIG. 2B for example schematically illustrates the inclusion of motor M.

Figure 2A:
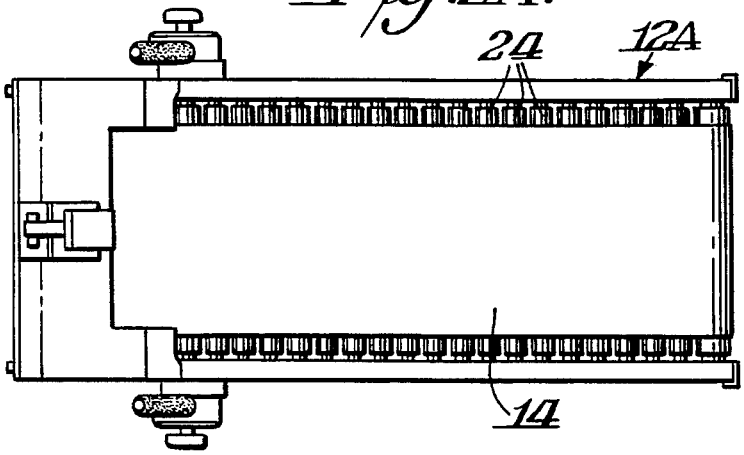
FIG. 2A is a view similar to FIG. 2 showing the treadmill in the form of a belt and rollers.
Figure 2B:
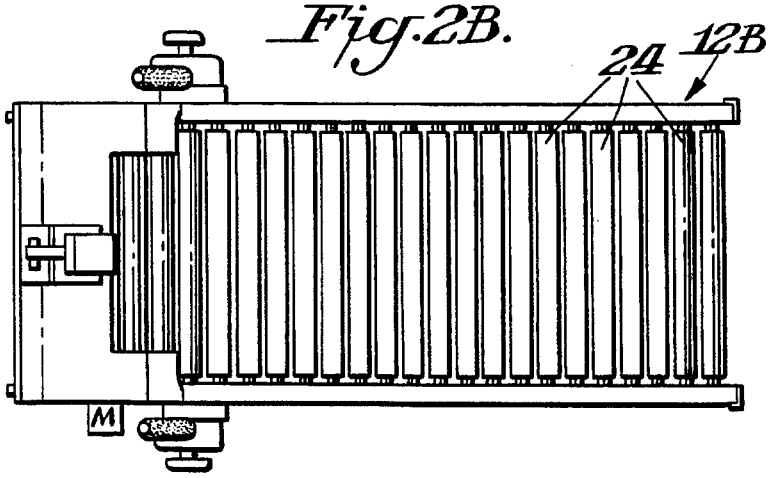
FIG. 2B is a view similar to FIGS. 2 and 2A showing the treadmill having rollers and no belt.

FIG. 2 illustrates one variation of treadmill 12 wherein the foot contact surface is belt 14. FIG. 2A illustrates a variation of treadmill 12A which includes a plurality of individual rollers 24 disposed below belt 14. This represents the preferred form of treadmill. FIG. 2B illustrates a further variation wherein the foot contact surface is the plurality of rollers 24 without there being any superimposed belt.

In accordance with this invention an arm exercise frame 26 having arm exercise unit 28 is mounted to treadmill frame 22. As later described in the preferred practice of this invention arm exercise frame 26 is adjustable in width and detachably mounted to treadmill frame 22 so as to be adapted to fit on various size treadmills.

The arm exercise unit 28 includes a pair of poles 30,30 with each pole being mounted at a respective side of treadmill frame 22.

Figure 3:
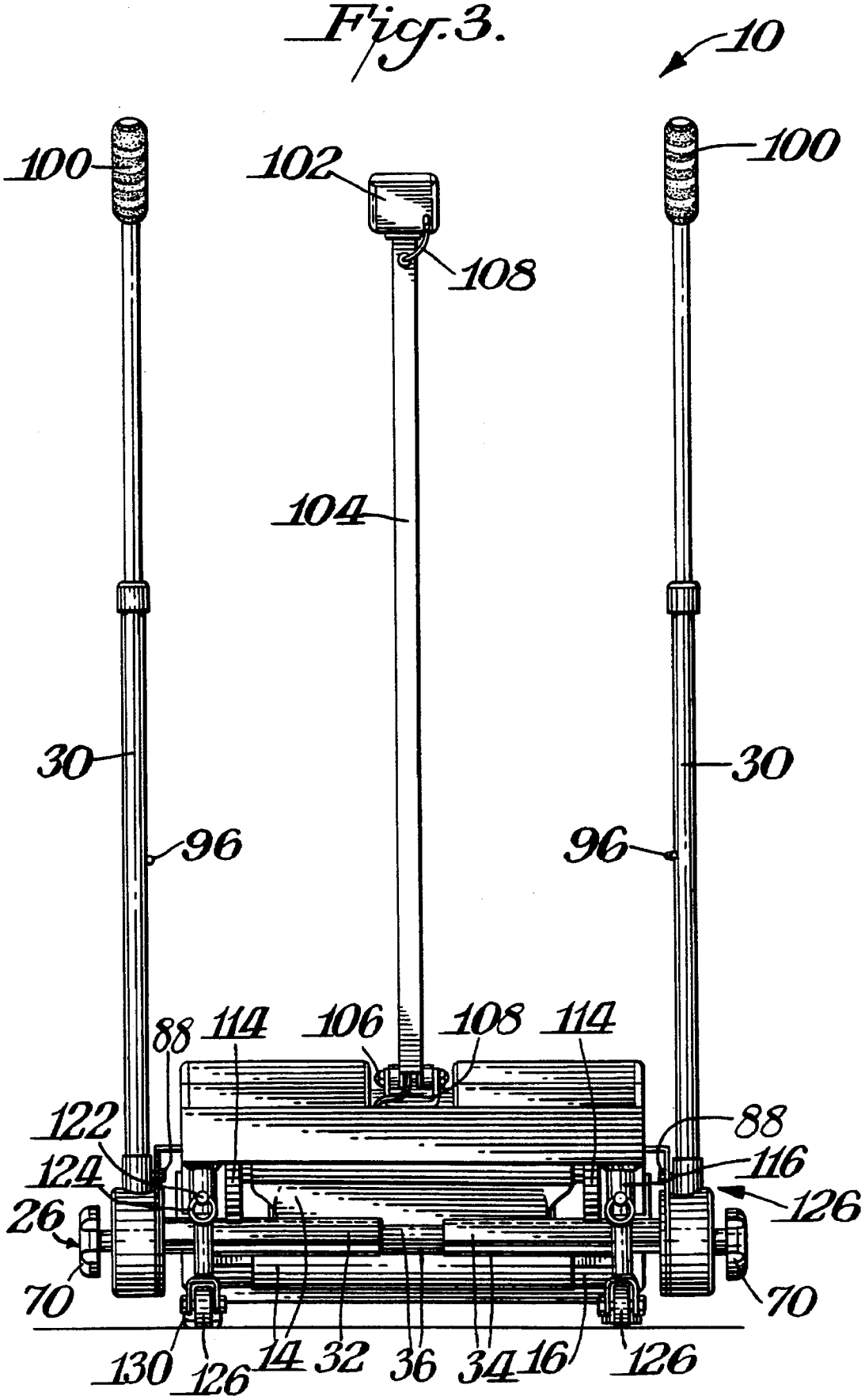
FIG. 3 is a rear elevational view of the device shown in FIG. 1.
Figure 4:
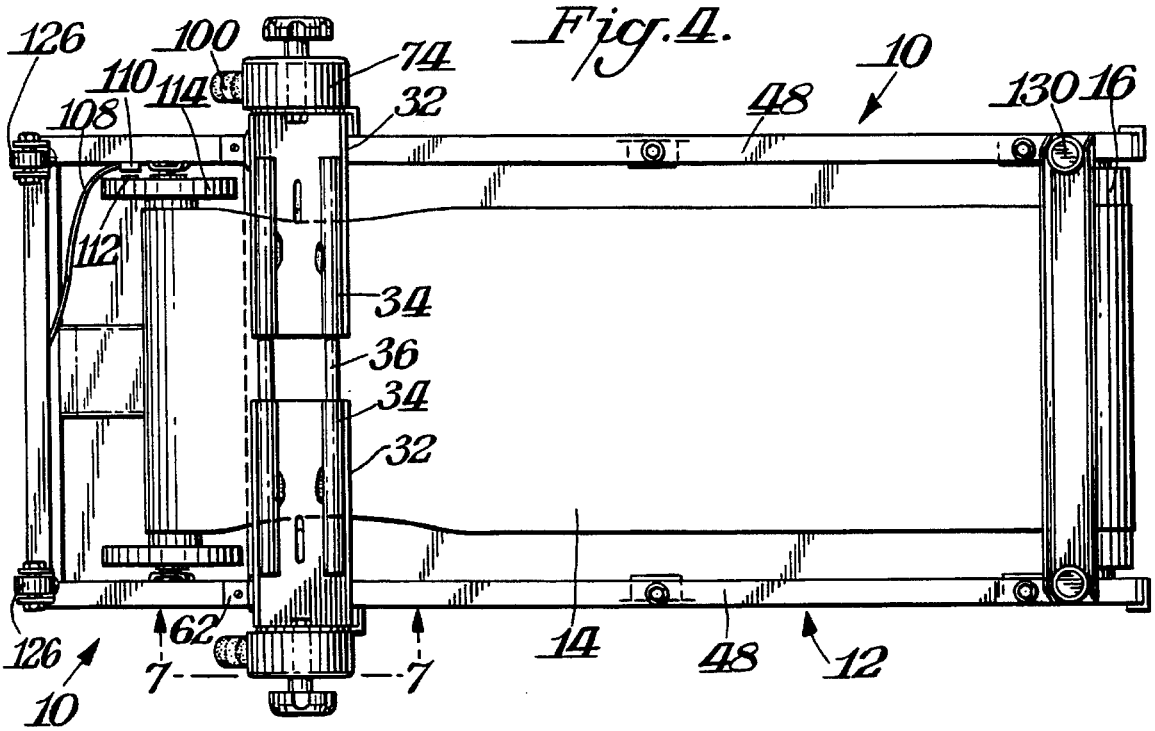
FIG. 4 is a bottom plan view of the device shown in FIGS. 1 and 3.
Figure 7:
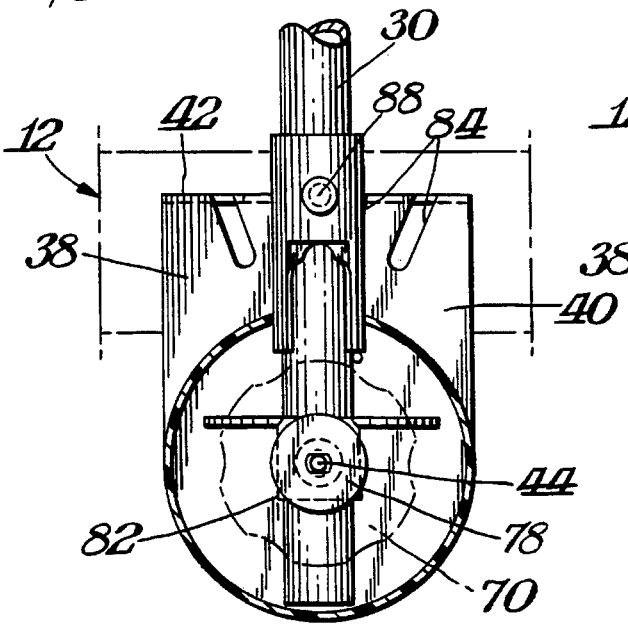
FIG. 7 is a cross-sectional view taken through FIG. 4 along the line 7—7.
Figure 8:
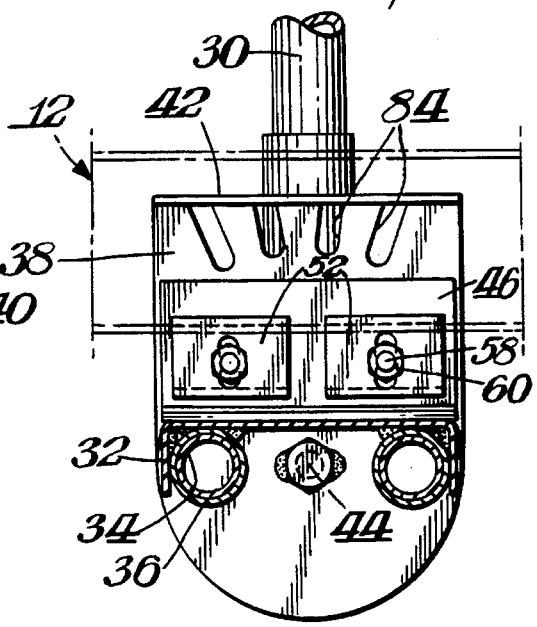
FIG. 8 is a cross-sectional view showing the rear portion of the device shown in FIG. 7.

As previously indicated in the preferred practice of this invention the arm exercise frame 26 is detachably mounted to the treadmill frame 22. This detachable mounting is based upon the principal of clamping the arm exercise frame 26 to the treadmill frame 22 which is facilitated by having the arm exercise frame adjustable in width. As illustrated in FIGS. 3 and 4 arm exercise frame 26 includes a pair of base members 32 which are in the form of an inverted U. A tube 34 is rigidly connected as by welding to each of the legs of the respective base members 32 so that four fixed tubes thereby result. A telescopic tube 36 is inserted in each pair of aligned fixed tubes 34 to permit the base member to be moved toward and away from each other and thereby adjust the width of frame 26.

Figure 6:
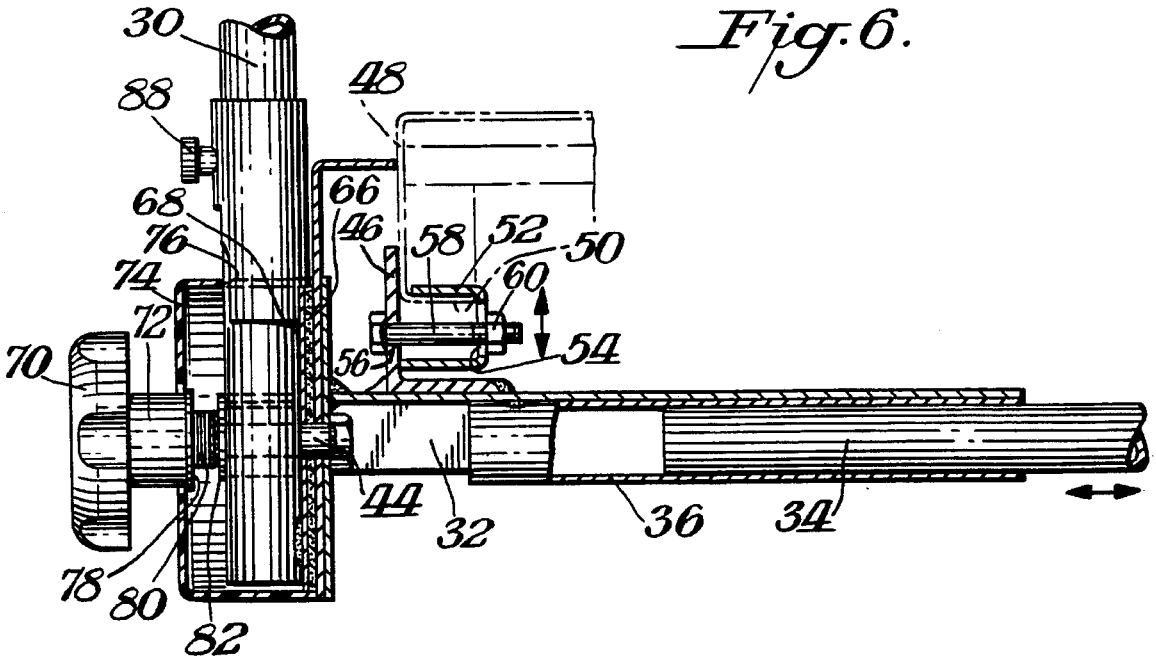
FIG. 6 is a side view partly in section of a portion of the device shown in FIGS. 1–5.

Each base member 32 includes a plate-like bracket mount 38 which has an elongated vertical side 40 and an inwardly turned perpendicular horizontal side 42. The horizontal side 42 abuts against frame 22 of treadmill 12. A hinge shaft 44 extends perpendicularly outwardly from vertical side 40 of bracket 38 as best seen in FIG. 6. Shaft 44 may be in the form of a rod having a smooth inner portion and terminating in a threaded end.

An L-shaped mounting member 46 is secured inwardly of bracket 38 by being mounted to the top of U-shaped base member 32. The treadmill frame 22 includes a vertical wall 48 parallel to mounting bracket 38. Vertical wall 48 terminates in an inwardly turned flange 50. A U-shaped bracket 52 rests on flange 50. Bracket 52 has a hole 54 in line with a hole 56 in L-shaped bracket 46. A bolt 58 extends through the aligned holes and locks brackets 46 and 50 together by nut 60. This locking action also detachably mounts arm unit frame 26 to treadmill frame 22. For stability purposes a pair of U-shaped brackets 50 are provided at each L-shaped bracket 46.

For further detachable securement of frame 26 to treadmill frame 22 an L-shaped bracket 62 is provided which is fixedly secured as by welding to base member 32 and detachably mounted to flange 50 of treadmill frame 22 by any suitable fasteners such as bolts 64 having nuts secured thereto. The L-shaped brackets 62 are shown for example in FIGS. 1 and 4.

Each pole 30 is pivotally mounted on a respective hinge shaft 44 as shown for example in FIG. 6. As also shown therein a brake disk or resistance plate 66 is mounted on shaft 44 between the disk member 68 secured to pole 30 and bracket 38. The degree of contact between pole disk 68 and resistance plate or disk 66 will determine the amount of force necessary for the user to pivot each pole during the arm exercise.

As also shown in FIG. 6 a knob 70 is threadably engaged with the threaded outer end of shaft 44. Knob 70 includes an inward boss 72 which is internally threaded and serves for the connection to shaft 44. Boss 72 extends through cup-like housing 74 mounted against bracket 38. Housing 74 includes a slot 76 through which pole 30 extends. Mounted on shaft 44 between boss 72 and pole 30 are a keywasher 78 having an oblong or slotted opening with a series of spring washers 80 disposed against keywasher 78. Next a flat washer then a thrust bearing and then another flat washer are mounted on shaft 44 against a U-shaped extension 82 which extends from pole disk 68.

As can be appreciated the frame 26 thus operates in a clamping manner to firmly lock onto various size frames of leg exercise units, such as the frame of treadmill 12. The arm unit frame 26 is disposed essentially underneath the frame 22 of the exercise device 12 and spans its width so that frame 26 runs from side to side and provides a pole 30 for each arm of the user. The clamp mechanism is designed to provide a very firm mount and to resist any forward/backward motion so that the user will get a smooth motion when using poles 30 over a fixed range with full exercise benefit.

When it is desired to adjust the force or resistance necessary for the user to move the poles 30 all that need be done is to rotate the knobs 70 clockwise or counterclockwise to increase or decrease the resistance.

FIG. 1A illustrates the poles 30 in solid lines and in phantom during the arm exercise.

Another feature of mounting bracket 38 is the inclusion of a plurality of slots 84 which extend into the top wall 42 and front face 40 of bracket 38. The slots 84 permit each pole to be mounted in a locked condition at a desired orientation when it is intended to have the pole function to provide balance to the user such as when the user performs a leg exercise without simultaneously performing an arm exercise. In order to achieve this adjustable locking condition each pole includes a sliding collar 86 which can freely rotate and be moved up and down on pole 30 by the user. Each collar 86 carries a pin 88 in the form of a T which is dimensioned to fit in the T-shaped slots 84. Since four slots 84 are provided four different locations are possible. It is to be understood, however, that the number of locations may be varied in accordance with the number of slots 84.

When it is desired to inactivate or lock the poles in a fixed position, the user rotates collar 86 and pivots pole 30 so that the locking pin 88 is disposed in line with the desired slot 84. The user then slides collar 86 down pole 30 until the locking pin 88 enters the appropriate slot thus preventing any rotational movement of pole 30. FIG. 5 illustrates on an enlarged scale locking pin 88 disposed in a T-shaped slot 84.

A further feature of this invention is the various adjustability to the poles 30 from a length and orientation standpoint. As illustrated for example, pole 30 is in the form of an outer tube 90 and an inner tube 92 telescopically positioned in tube 90. Columns of holes 94 are disposed around the periphery of outer tube 90. The various columns are staggered with respect to each other to provide greater height selectivity. Inner pole 92 includes a spring biased locking pin 96 which would engage a selective hole 94. FIG. 1, for example, illustrates pole 30 when the locking pin 96 is in the uppermost hole 94. By providing sets of holes around the periphery it is not only possible to adjust the height of pole 30, but also its angular orientation. In this respect, the poles have a bent portion 98 with foam grips 100 to facilitate the comfort in use of the poles. The bent portions of poles 30 provide better ergonometric design. The telescoping action and sets of vertically spaced and peripherally spaced holes permits poles 30 to be adjusted to accommodate various sizes of people and various types of machines.

A further feature of device 10 is the inclusion of an electronic readout mechanism 102 to provide various readings to the user to indicate the type of exercise being performed. Such devices are known in the art and might include, for example, a timer, a speed indicator, a speed selector, a reset, a stop and various other known indicating means. As illustrated, the read out unit 102 is mounted to the top of column 104 which is pivotally connected to frame 22 by pivot pin 104. The various figures illustrate the electrical wiring 108 for reading unit 102. See, for example, FIGS. 3 and 4.

FIG. 4 also illustrates the inclusion of a suitable sensor 110 mounted to frame 22. A fly wheel 114 includes a magnetic member 112 which is sensed each time it passes sensor 110 to provide a count of the number of revolutions of the fly wheel 114 so as to provide the user with a read out indicative of the speed and/or distance that the treadmill 12 is being used.

A further feature of device 10 is the inclusion of adjustable legs 116 at the front end of frame 22. Legs 116 may be of any suitable form such as including an outer tube 118 into which an inner tube 120 is telescopically mounted. Outer tube 118 would have a pair of aligned openings through which a locked pin 122 may be inserted. Inner tube 120 would have a series of vertical holes extending therethrough so that the locked pin could extend through the holes in locked tube 118 and the appropriate hole of inner tube 120, thus providing height adjustment to the legs 116. To facilitate manipulation of lock pin 122 a ring 124 is provided for each lock pin 122 by the ring 124 extending through holes in lock pin 122 so that the ring 124 is freely mounted. Wheel or roller 126 is provided on the remote end of each leg 116 to facilitate moving device 10. The rear end of treadmill frame 122 includes a set of fixed legs 128 having pads 130 made from rubber or any other suitable material.

When it is desired to store device 10 the various parts of device 10 may be manipulated so that the resulting assembly is of compact easy to remove size. For example, poles 30 would be manipulated so that the inner tubes 92 are retracted into outer tubes 90 the full extent. Poles 30 would then be rotated so as to be disposed along side treadmill frame 122. The nut on the end of threaded hinge pin 106 for column 104 would be loosened so that column 104 could be rotated against belt 14. Legs 116 would be manipulated to extend inner tube 120 the full extent into outer tube 118. In this compact position frame 22 may be grasped by the user such as at roller 16 to lift the folded unit which may then be wheeled on wheels or rollers 126.

As previously indicated the preferred practice of this invention is to provide the arm exercise unit as a detachable unit and more particularly one that is adjustable in width so that the arm exercise unit 28 could be mounted on any existing leg exercise unit such as a treadmill 12. It is to be understood, however, that the invention may be practiced where the arm exercise unit is fixedly mounted rather than detachably mounted to the leg exercise unit. Such fixed mounting would be of simpler construction in avoiding the need for width adjustability and the other components necessary for the detachable mounting. Such practice of the invention, however, would not have the advantage of being able to be detached and mounted to any leg exercise unit.

It is also to be understood that where poles 30 are used solely to provide balance to the user while the user does a leg exercise or other aerobic exercise, it is not necessary that both poles be disposed in the same orientation. Thus, the angular orientation of the tube poles may be varied by varying the slot 84 selected for engagement by the respective locking pin 88. Similarly, the rotation orientation of each pole and the length of each pole may be varied with respect to each other by the selection of the appropriate hole for locking pin 96.

The arm exercise device thus provides a unit which could fit on an aerobic exercise machine to give an upper body or total body exercise. As noted, such aerobic exercise machines are not limited to treadmills and could include such other devices as XC ski machines, bicycles and steppers. The arm exercise unit is adapted to the permanently or detachably mounted to any such aerobic exercise machine. In the broad practice of this invention wherein the arm exercise unit is detachably mounted such detachable mounting could include one or more detachable brackets/posts that fit on handle bars, handle bar posts, bike frames, treadmill side frames, treadmill front or back frames, stepper hand rails, stepper frames or on a base plate underneath a particular aerobic exercise machine. As can be appreciated the poles 30 are totally adjustable by providing various heights and various orientations for proper balance and for also providing the ability of the poles to swing free for use in an arm exercise. The provision of one or more tension adjustments also advantageously provides for a various adjustable workout resistance range. The ability of the poles and particularly the top handles to rotate a full 360° and be locked at various positions permits the accommodation of different users and thus achieves an individualized comfort or feel. In the preferred form of the invention the poles terminate in a bent portion. The invention, however, may be practiced where the poles are completely straight.

Device 10 not only provides an effective total exercise device, but also lends itself to easy transportability and storage. This is achieved by the ability to be able to fold the poles and column adjacent to or against the treadmill frame. The provision of the adjustable legs 116 at the end of frame 22 not only provides a ready location for wheels which facilitates transporting the folded device 10 in its compact form, but also the extended length of legs 116 provide a support or base to permit the folded device 10 to be stored in an upright condition with the treadmill frame vertically disposed supported by legs 116.

As previously noted the arm exercise device may be permanently attached to the leg exercise unit. For example, where a treadmill is used the mount 38 of the arm exercise device could be integral with frame 22 of treadmill 12 by welding or otherwise securing mount 38 to frame 22 or by forming mount 38 as part of frame 22 when frame 22 is being manufactured.

FIGS. 9–11 illustrate a self-contained arm exercise unit 200 which is designed to include the features of device 10. Unit 200 is particularly designed so that it can slide under a leg exercise unit. In this respect instead of providing width adjustability by means of a telescopic tube such as tube 36 which slides in outer tube 34, a plate like frame is provided. As shown in FIGS. 9–11 the plate like frame includes a lower plate member 202 and an upper plate member 204. Upper plate member 204 includes a pair of elongated slots 206 as best shown in FIG. 11. A pair of thumb screws 208 is secured to lower plate 202 and extends through slots 206 so that the relative position of sliding plate 204 on base plate 202 could be controlled by tightening the thumb screws 208 to lock the plates 202 and 204 together at a desired width. Plate 202 includes an upstanding wall 210 having a foam pad 212 attached thereto. Similarly, an L-shaped bracket 214 is mounted to slide plate 204 with a foam pad 216 attached thereto. Unit 200 would include an adjustable resistance assembly such as the frictional resistance means described in connection with device 10.

In the embodiment illustrated in FIGS. 9–11 unit 200 is slid under a conventional leg exercise unit in the form of a stepper 218. The upper surface 220 of slide plate 204 may be made of a non-slip material to assure that stepper 218 remains in place on plate 204. If desired, a non-slip material may also be provided on the lower surface of base plate 202.

In use, unit 200 would be slid under stepper 218. The resistance would be adjusted by the turning of knob 70 in the manner previously described. The user would then use stepper 218 in a conventional manner while performing an arm exercise by means of pulls 30. Thus, while the user steps up and down on steps 222 the user would also be performing an arm exercise by movement of poles 30. Since stepper 218 is of conventional construction a detailed discussion of the structure of stepper 218 is not necessary. Any stepper could be used which is capable of being mounted directly on plate 204.

It is to be understood that although in the preferred practice of this invention the width of unit 200 is adjustable the invention may also be practiced where unit 200 has a fixed width with the sides being selected to accommodate standard leg exercise units. Where there is a fixed width it is only necessary to have a single plate rather than the base plate and the slide plate with the slots and thumb screws.

Foam pads 212 and 216 permit the upstanding walls 210 and the vertical wall of bracket 214 to be disposed in tight frictional contact with the frame of the leg exercise unit when slide plate 204 is moved inwardly an appropriate distance. This firm frictional contact in addition to the non slip surface 220 and in addition to the weight of the leg exercise unit on plate 204 assures the leg exercise unit being maintained in place on the arm exercise unit 200 during use of the device.

The plates 202 and 204 may be considered a spanning assembly which interconnects the poles 230 to each other and provides a location on which the leg exercise unit is detachably mounted. This is similar to the spanning unit formed by telescopic tubes 34,36. It is to be understood that it is not necessary for the spanning unit to be adjustable so as to vary the distance between the poles since the spanning unit may be of fixed dimension.

Figure 13:
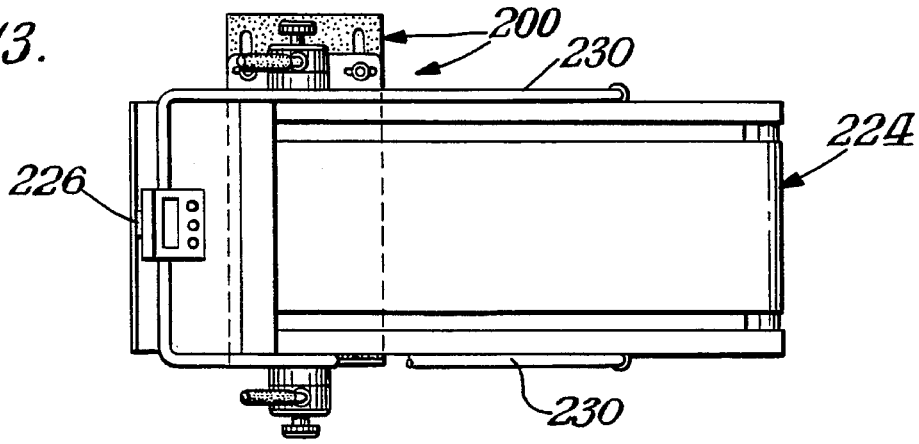
FIG. 13 is a top plan view of the device shown in FIG. 12.
Figure 12:
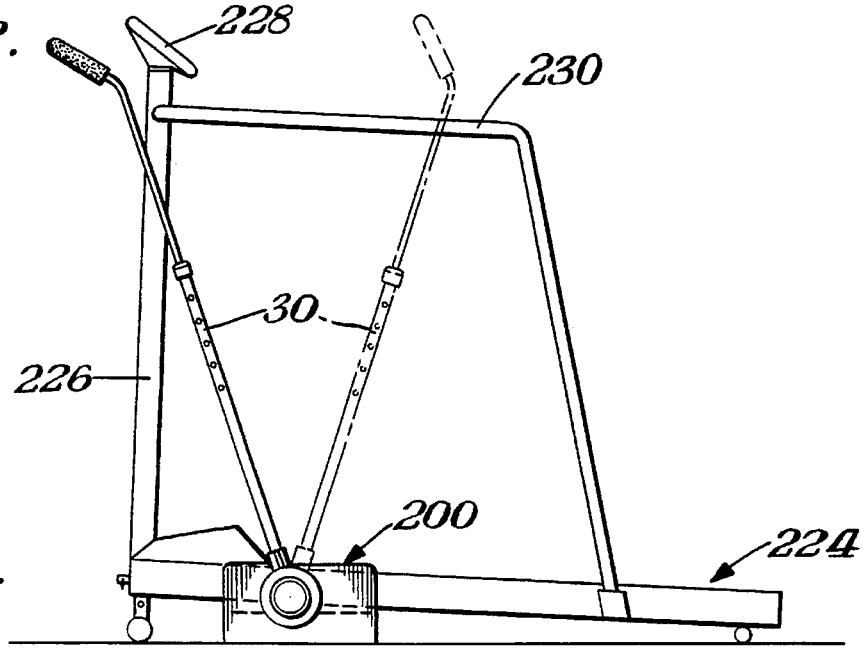
FIG. 12 is a side elevational view of the arm exercise unit shown in FIGS. 9–11 used in combination with a treadmill.

FIGS. 12–13 show the use of the arm exercise unit 200 with a treadmill 224. This embodiment differs from that of FIGS. 1–8 in that the combination of arm exercise unit 200 and treadmill 224 is achieved by sliding unit 200 under the treadmill 224. FIGS. 12–13 also illustrate a variation in a known treadmill structure which includes a center post 226 having a known electronic read out unit 228 at its top with a pair of support arms 230 extending from the center post 226 and being disposed parallel to the treadmill belt.

Figure 14:
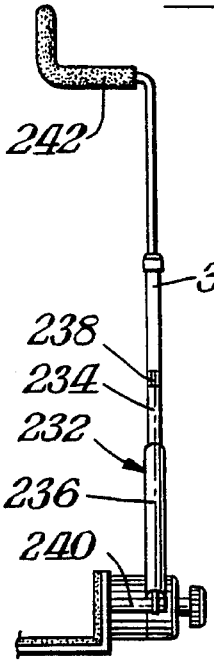
FIG. 14 is a front elevational view of a modified form of arm exercise device.
Figure 15:
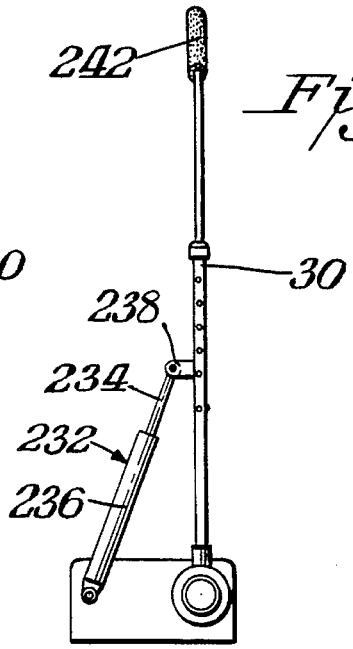
FIG. 15 is a side elevational view of the device shown in FIG. 14.

FIGS. 14–15 illustrate an alternative adjustable resistance means which could be used in any embodiment of this invention. As shown therein instead of using a frictional plate the adjustable friction is achieved by a hydraulic cylinder assembly 232 which includes a piston 234 extending from a cylinder 236. Piston 234 is pivotally connected to bracket 238 and cylinder 236 is pivotally connected to rod 240. The pressure in the piston cylinder assembly could be varied in a conventional manner to adjust the resistance resulting from the movement of poles 30 which causes piston 234 to extend from and retract into cylinder 236.

FIGS. 14–15 also illustrate a modified handle structure 242 which is of L-shaped form.

Figure 16:
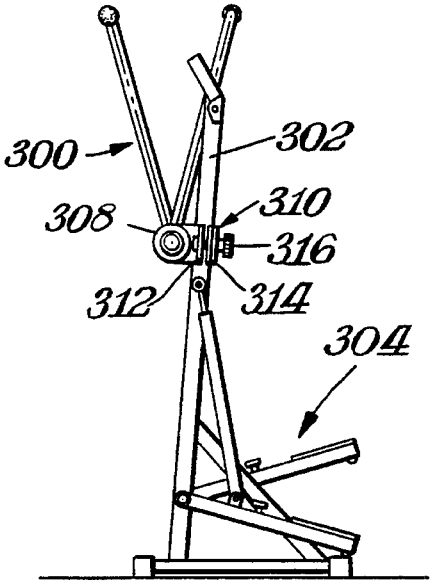
FIG. 16 is a side elevational view of a modified form of exercise device used on a stepper.
Figure 17:
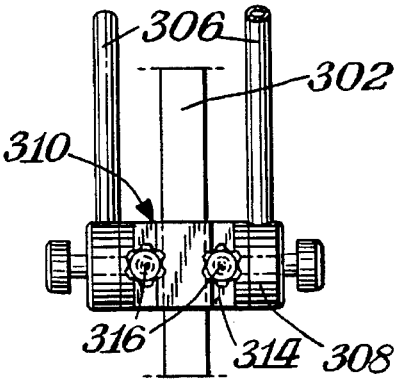
FIG. 17 is a front elevational view of the device shown in FIG. 16.

Arm exercise unit 200 could be used with any suitable leg exercise unit by simply sliding the plate of arm exercise unit 200 under the leg exercise unit. Such leg exercise units could include the types of devices previously mentioned, such as stationary bikes, cross-country ski machines, trampolines, rowers, chairs and benches. It is also possible, however, to practice the invention by forming an arm exercise unit of smaller size and which mounts to the leg exercise unit at a higher elevation such as at a center post or handle bars. Parent application Ser. No. 986,487 illustrates an arm exercise unit which could be mounted to a trampoline. The details of that application are incorporated herein by reference thereto. FIGS. 16–17 show how the concepts of the parent application are applied to a stepper. As shown therein an arm exercise unit 300 is provided which is mounted to the center post 302 of stepper 304. Arm exercise unit 300 includes a pair of poles 306 secured to adjustable resistance units 308. Unit 300 also includes a clamping mechanism 310 and a pair of jaw members 312,314 which are adjustably secured together by screw or fastener 316 after the clamping members 312 and 316 are mounted around center post 302 of stepper 304.

Figure 18:
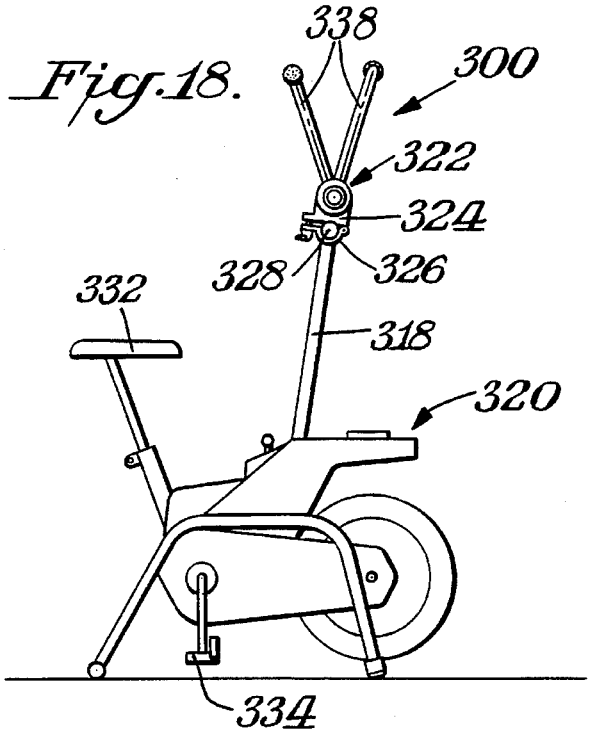
FIG. 18 is a side elevational view of a modified form of arm exercise device used on a stationary bicycle.
Figure 19:
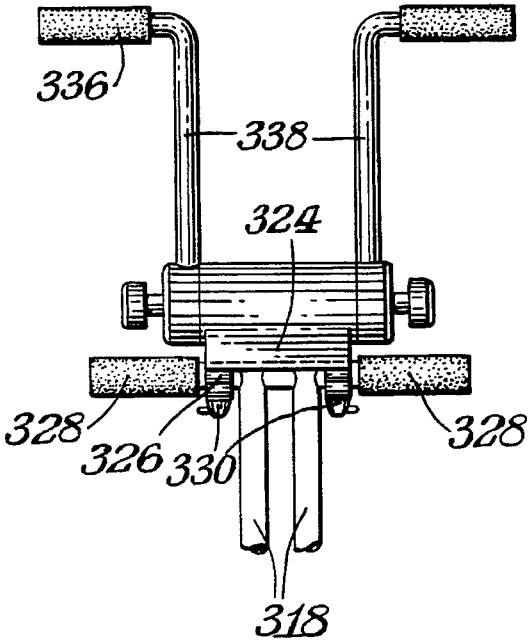
FIG. 19 is a front elevational view of the device shown in FIG. 18.

FIGS. 18–19 illustrate the arm exercise unit mounted to the center post 318 of a stationary bike 320. As shown therein a modified clamp 322 is used which includes an upper mount 324 and a lower pivoted clamp jaw 326 for clamping around the handle bar 328 of the stationary bike 320 in the general area of the center posts 326. Once the unit 300 is assembled on the handle bars 328 screw or other fastener 330 is manipulated to clamp unit 300 in place.

Since stationary bike 320 could be of any known conventional construction a detailed description is not necessary. As is apparent, however, the user would sit on seat 332 and perform a leg exercise by pedaling at pedals 334. The user would have a choice of grasping the stationary bike handle bars 328 or the offset handles 336 of poles 338.

Figure 20:
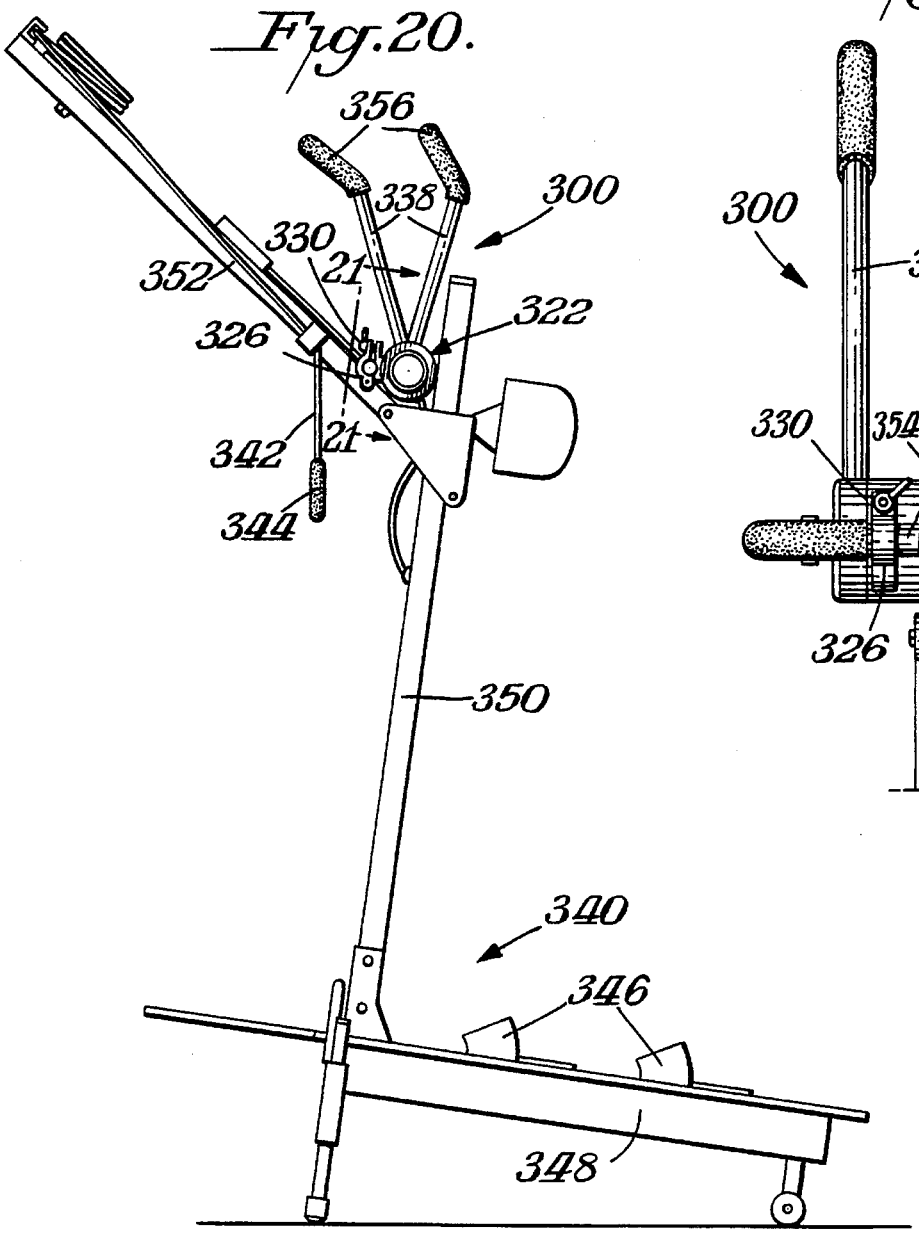
FIG. 20 is a side elevational view of a modified form of arm exercise device used on a cross-country ski machine.
Figure 21:
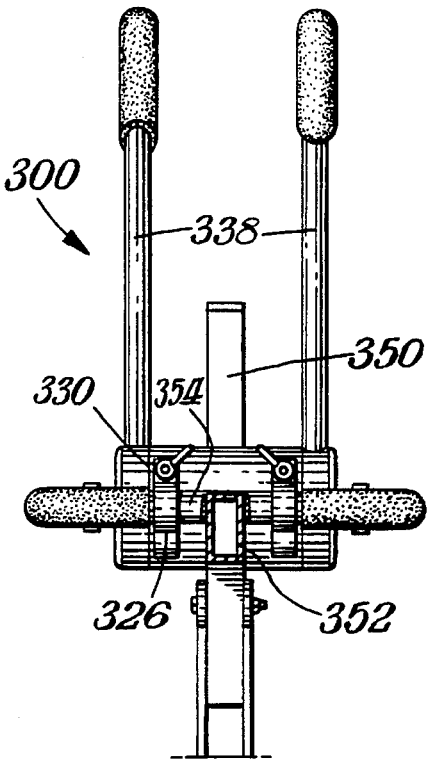
FIG. 21 is a cross-sectional view taken from FIG. 20 along the line 21—21.

FIGS. 20–21 illustrate the use of unit 300 being mounted to a known cross-country ski machine 340. Any suitable XC ski machine could be used. FIGS. 20–21 illustrate the Aerobic Cross-Trainer by NordicTrack. Machine 340 includes a pair of cords 342 (only one of which is illustrated) terminating in a handle 344 which could be pulled by the user while the user's feet are inserted in receptacles 346 which are mounted on base 348 so that the user can slide the user's legs back and forth while the feet are in receptacles 346. Machine 340 also includes a center post 350 with a support bar 352 extending therefrom on which the cords 342 are mounted. A horizontal rod 354 is mounted above support bar 352. Unit 300 is clamped on rod 354 by use of the clamping mechanism 322 previously described.

By mounting unit 300 on ski machine 340 the user has the choice of performing an arm exercise by means of cords 342 or by means of poles 338 by grasping inclined handles 356 on poles 338.

It is to be understood that the various shorter versions of the arm exercise unit 330 could be mounted on leg exercise units other than those specifically illustrated such as a treadmill which was illustrated as having a full length unit associated therewith.

Figure 22:
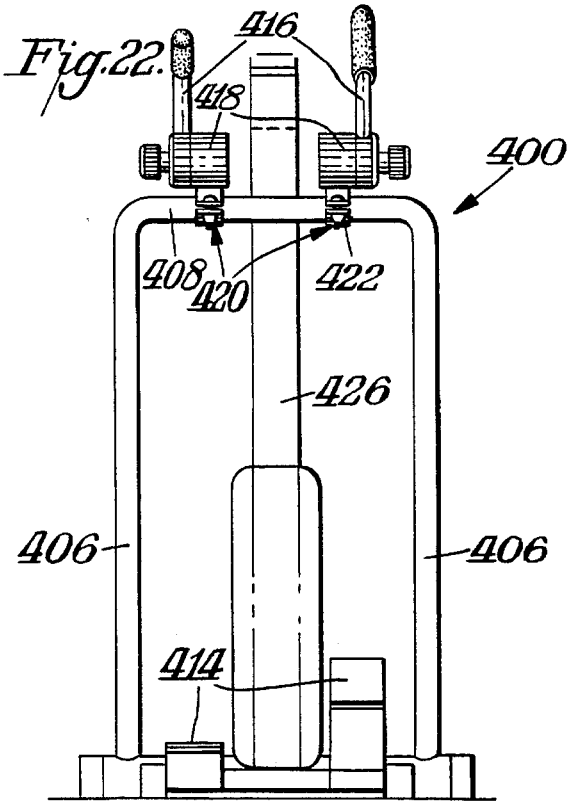
FIG. 22 is a front elevational view of a modified form of an arm exercise device used with a stepper.
Figure 23:
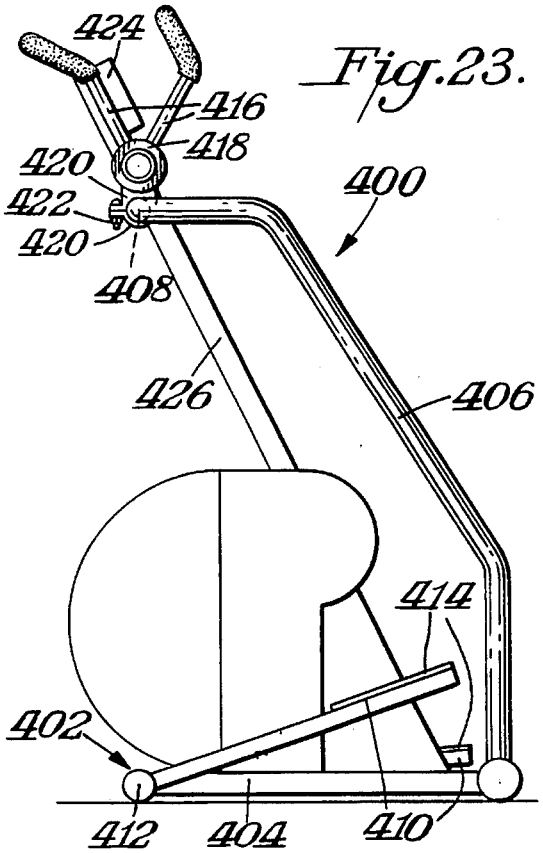
FIG. 23 is a side elevational view of the device shown in FIG. 22.

FIGS. 22–23 show a further arm exercise device 400 in accordance with this invention. As shown therein a stepper 402 of any suitable construction may be used which includes a horizontal frame 404 and a pair of upstanding arms interconnected by a horizontal arm 408. The stepper 402 would include a pair of individual steps 410 pivoted at one end by pivot mechanism 412 and having an upwardly biased free end with a step surface 414 onto which the user would step to move each step up and down.

A pole mechanism comprising a pair of poles 416 having resistance means 418 as previously described is mounted to horizontal rail 408 by a clamp mechanism comprising a pair of clamp jaws 418,420 detachably connected together by a fastening arrangement 422 in a known manner for clamping mechanisms as previously described. Where stepper includes a electronic unit 424 on a center mount 426 each pole 416 could be mounted on a respective side of the electronic unit, preferably equally spaced from the electronic unit although the spacing need not be equal.

It is to be understood that any suitable form of stepper could be used in the practice of this invention, such as the types of steppers disclosed in U.S. Pat. No. 4,659,075 the details of which are incorporated therein by reference thereto, wherein the steps are interconnected by a suspended cord. Where pivoted legs are used the pivot location need not be at an end but could be at some other location even the center of each step.

Figure 24:
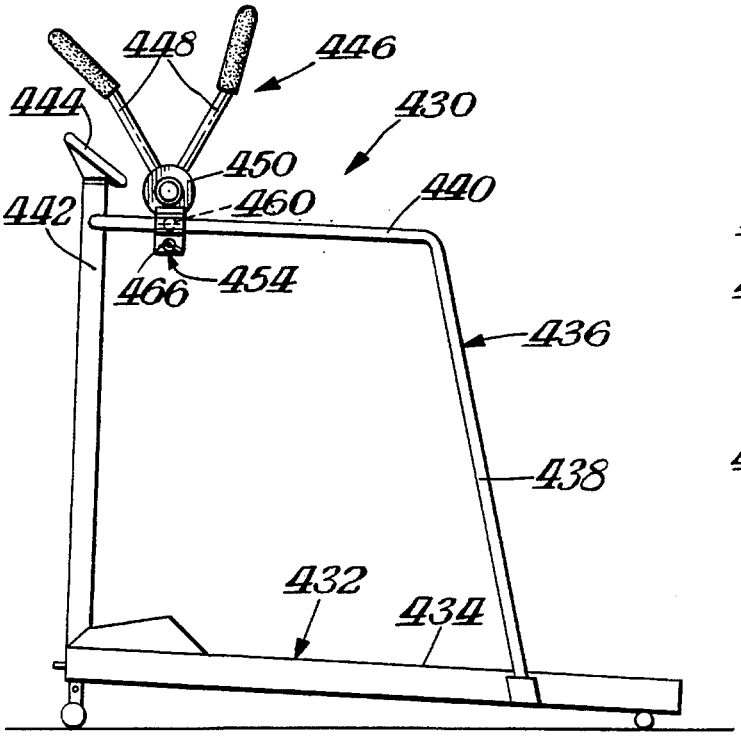
FIG. 24 is a side elevational view of a further modified form of arm exercise device used on a treadmill.
Figure 25:
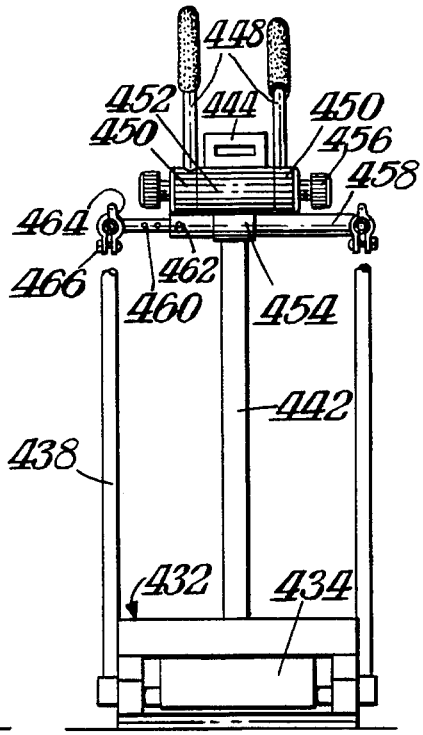
FIG. 25 is a front elevational view of the device shown in FIG. 24.

FIGS. 24–25 show a further device 430 in accordance with this invention. As shown therein a treadmill 432 of any suitable known construction could be used. Treadmill 432 includes the foot support surface 434 and an arm rail unit 436 on each side of the foot support surface. Arm rail unit 436 includes a pair of generally vertical rails 438 each of which bends into a horizontal rail 440 which in turn are inwardly directed to connect to a center mount 442. Center mount 442 includes a known electronic panel 444. The pole unit 446 comprises a pair of poles 448 each of which is mounted to a resistance mechanism 450 interconnected by block 452. The block 452 in turn includes a clamping mechanism 454 mounted onto a horizontally adjustable telescopic rod arrangement 456 which includes an outer rod 458 and an inner telescopic rod 460. Rod 460 is locked in position in any suitable manner, such as by a spring pin 462 engaged in a corresponding hole. The end of each rod 458,460 includes a clamp mechanism having a pair of C-clamps 464 pivotally mounted at one end and secured together by a suitable fastener 466 so that each end of the rod mechanism 456 could be mounted to the horizontal rails 440 in front of the electronic panel 444. The exact positioning on rails 440 is adjusted in accordance with the location of the clamp mechanisms. Similarly, the position of the poles on rod assembly 456 is adjusted in accordance with the location selected for clamp mechanism 454. Because of the adjustability of the length of rod mechanism 456 this pole arrangement 446 could be accommodated to any spacing of rails on the treadmill.

It is to be understood that various features shown with respect to various embodiments may be used with other embodiments and no one embodiment is intended to be limited to the specific details shown therein.

What is claimed is:

1. An arm exercise device to supplement leg exercising comprising a leg exercise unit in the form of a treadmill, said treadmill including a frame and a rotatably mounted foot contact surface mounted about a pair of spaced shafts for rotating around said shafts as the user walks or runs by lifting and lowering the user's legs while on said foot contact surface, a pair of poles, each of said poles terminating in an upper end comprising a handle for being grasped by the user, each of said poles being detachably mounted to said frame by mounting structure, part of said mounting structure being adjacent to said foot contact surface, said foot contact surface being between said handles whereby the user may walk or run on said foot contact surface while grasping said handles, said mounting structure including shaft means, each of said poles being rotatably mounted to said shaft means for back and forth pivotal movement around said shaft means, adjustable friction resistance means on said shaft means for creating a resistance to the pivotal movement of said poles, structure separate from said resistance means for locking said poles to said mounting structure and resistance setting means rotatably mounted on said shaft means for controlling the resistance force of said resistance means in accordance with the rotation of said resistance setting means on said shaft means to thereby control the force required by a user to pivot said poles back and forth to provide for an arm exercise simultaneously with the use of said treadmill.

2. The device of claim 1 wherein said mounting structure includes a spanning assembly, and said poles being interconnected by said spanning assembly.

3. The device of claim 2 wherein said spanning assembly is adjustable in length to accommodate different size leg exercise devices.

4. The device of claim 2 wherein said spanning assembly includes a base plate, a slide plate slidably mounted on said base plate, and said leg exercise unit being mounted over said slide plate.

5. The device of claim 3 wherein said slide plate includes a non-skid upper surface, at least one elongated slot in said slide plate, and at least one fastener connected to said base plate and extending through said slot for adjustably locking said slide plate to said base plate.

6. The device of claim 1 wherein said resistance means includes a friction plate on said shaft means reacting against said poles, and said resistance setting means on said shaft means being movably mounted selectively toward and away from said friction plate.

7. The device of claim 1 wherein said leg exercise unit includes a center post extending above said foot contact surface, said mounting structure including a clamping assembly, said poles being interconnected by said clamping assembly, and said clamping assembly being detachably mounted to said leg exercise unit at said center post.

8. The device of claim 1 wherein said resistance setting means includes a knob threadably engaged around said shaft means whereby removal of said knob exposes said shaft means.

9. The device of claim 1 wherein said resistance setting means is provided at each of said poles for independently setting the resistance of one of said poles with respect to the other of said poles.

* * * * *

UNITED STATES PATENT AND TRADEMARK OFFICE
CERTIFICATE OF CORRECTION

PATENT NO.: 5,460,586

DATED: October 24, 1995

INVENTOR(S): William T. Wilkinson

It is certified that error appears in the above-identified patent and that said Letters Patent is hereby corrected as shown below:

Column 11, line 13 after "structure" add --,--.

Signed and Sealed this

Fifth Day of November, 1996

*Attest:*

Bruce Lehman

BRUCE LEHMAN

*Attesting Officer*

*Commissioner of Patents and Trademarks*